US012765629B2

(12) United States Patent
Hawkins

(10) Patent No.: US 12,765,629 B2
(45) Date of Patent: Oct. 20, 2026

(54) FOOTWEAR WITH MULTIPLE LOCKDOWN CONFIGURATIONS

(71) Applicant: Under Armour, Inc., Baltimore, MD (US)

(72) Inventor: Spencer Hawkins, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 18/908,716

(22) Filed: Oct. 7, 2024

(65) Prior Publication Data

US 2025/0113895 A1 Apr. 10, 2025

Related U.S. Application Data

(63) Continuation of application No. 17/891,283, filed on Aug. 19, 2022, now Pat. No. 12,108,835.

(60) Provisional application No. 63/235,130, filed on Aug. 19, 2021.

(51) Int. Cl.

| | |
|---|---|
| ***A43B 3/24*** | (2006.01) |
| ***A43B 23/02*** | (2006.01) |
| ***A43C 11/14*** | (2006.01) |
| *A43B 3/00* | (2022.01) |
| *A43B 5/02* | (2006.01) |

(52) U.S. Cl.

CPC ..... *A43B 3/242* (2013.01); *A43B 23/027* (2013.01); *A43C 11/1493* (2013.01); *A43B 3/0036* (2013.01); *A43B 5/025* (2013.01)

(58) Field of Classification Search

CPC .... A43B 3/242; A43B 23/027; A43C 11/1493

USPC ..... 36/1

See application file for complete search history.

(56) References Cited

U.S. PATENT DOCUMENTS

| | | | | |
|---|---|---|---|---|
| 2,357,980 | A * | 9/1944 | Spiro | A43C 1/00 36/50.1 |
| 2,675,631 | A | 4/1954 | Doughty | |
| 4,621,648 | A * | 11/1986 | Ivany | A43D 999/00 602/65 |
| 5,109,614 | A | 5/1992 | Curry | |
| 6,651,257 | B2 | 11/2003 | Smith | |
| 7,094,213 | B1 * | 8/2006 | Cook | A61F 13/065 602/65 |
| 7,726,045 | B2 * | 6/2010 | Riebesell | A43B 3/06 36/109 |
| 9,402,437 | B2 | 8/2016 | Berns et al. | |
| 10,441,451 | B2 * | 10/2019 | Ostergard | A43B 7/20 |

(Continued)

*Primary Examiner* — Timothy K Trieu

(74) *Attorney, Agent, or Firm* — Maginot, Moore & Beck, LLP

(57) ABSTRACT

An article of footwear includes a sole, an upper, a first collar fastener, a second collar fastener, and a strap. The upper is connected to the sole and includes a hindfoot portion and a collar extending from the hindfoot portion. The collar is configured for movement between a first position in which a first side of the collar is an exterior side, and a second position in which an opposite second side of the collar is the exterior side. The first collar fastener is mounted to the first side of the collar. The second collar fastener is mounted to the second side of the collar. The strap extends from the upper and includes a strap fastener. In the first position of the collar, the first collar fastener connects to the strap fastener. In the second position of the collar, the second collar fastener connects to the strap fastener.

6 Claims, 7 Drawing Sheets

(56) References Cited

U.S. PATENT DOCUMENTS

| | | | | |
|---|---|---|---|---|
| 10,669,654 | B2 | 6/2020 | Zavala | |
| 2008/0078105 | A1 | 4/2008 | Riebesell | |
| 2017/0238645 | A1 | 8/2017 | Arin | |
| 2019/0313742 | A1* | 10/2019 | Bell | A43B 1/0054 |

* cited by examiner

FOOTWEAR WITH MULTIPLE LOCKDOWN CONFIGURATIONS

CROSS-REFERENCE TO RELATED APPLICATIONS

This patent application is a continuation of U.S. patent application Ser. No. 17/891,283, filed Aug. 19, 2022, now U.S. Pat. No. 12,108,835, which claims priority from U.S. Provisional Patent Application No. 63/235,130, filed Aug. 19, 2021, the entire contents of which are incorporated herein by reference.

FIELD

This disclosure relates to the field of footwear and, in particular, to athletic footwear.

BACKGROUND

Athletic footwear is worn in a variety of activities including running, walking, hiking, team and individual sports, and any activity where protection and support of the wearer's feet are desired. Athletic footwear is available in exemplary styles including low-top shoes, mid-top shoes, and high-top shoes with each style having particular benefits for certain activities, field conditions, and/or physiological preferences. For example, an American football athlete may prefer a high-top shoe to provide additional ankle support during wet field conditions or if playing with an ankle injury. On the other hand, the athlete may prefer a low-top shoe or a mid-top shoe to provide more flexibility during dry field conditions. In each situation, the athlete requires a well-fitting shoe that provides a desired amount of support for the foot and assists the athlete in performing at their highest level. Accordingly, additional developments in the field of athletic footwear are desired.

SUMMARY

According to an exemplary embodiment of the disclosure, an article of footwear includes a sole, an upper, a first collar fastener, a second collar fastener, and a strap. The upper is connected to the sole and includes a hindfoot portion and a collar extending from the hindfoot portion. The collar is configured for movement between (i) a first position in which a first side of the collar is an exterior side of the upper, and (ii) a second position in which an opposite second side of the collar is the exterior side of the upper. The first collar fastener is mounted to the first side of the collar. The second collar fastener is mounted to the second side of the collar. The strap extends from the upper and includes a strap fastener. In the first position of the collar, the first collar fastener is configured to connect to the strap fastener. In the second position of the collar, the second collar fastener is configured to connect to the strap fastener.

According to another exemplary embodiment of the disclosure, an article of footwear includes a sole, an upper, at least one first collar fastener, and at least one second collar fastener. The upper is connected to the sole and includes a hindfoot portion and a collar extending from the hindfoot portion. The collar is configured for movement between (i) an upright position in which a first side of the collar is an exterior side, and (ii) a lowered position in which an opposite second side of the collar is the exterior side. The at least one first collar fastener is mounted to the first side of the collar. The at least one second collar fastener is mounted to the second side of the collar.

According to yet another exemplary embodiment of the disclosure, an article of footwear includes a sole, an upper, at least one first collar fastener, and at least one second collar fastener. The upper is connected to the sole and includes a hindfoot portion and an open collar extending from the hindfoot portion. The open collar defines a collar opening, and the upper defines a throat opening aligned with the collar opening. The at least one first collar fastener is mounted to a first side of the collar. The at least one second collar fastener is mounted to an opposite second side of the collar. The collar is configured for movement between (i) a first position in which the first side of the collar is an exterior side of the collar and the second side of the collar is an interior side of the collar, and (ii) a second position in which the second side of the collar is the exterior side of the collar and the first side of the collar is the interior side of the collar.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
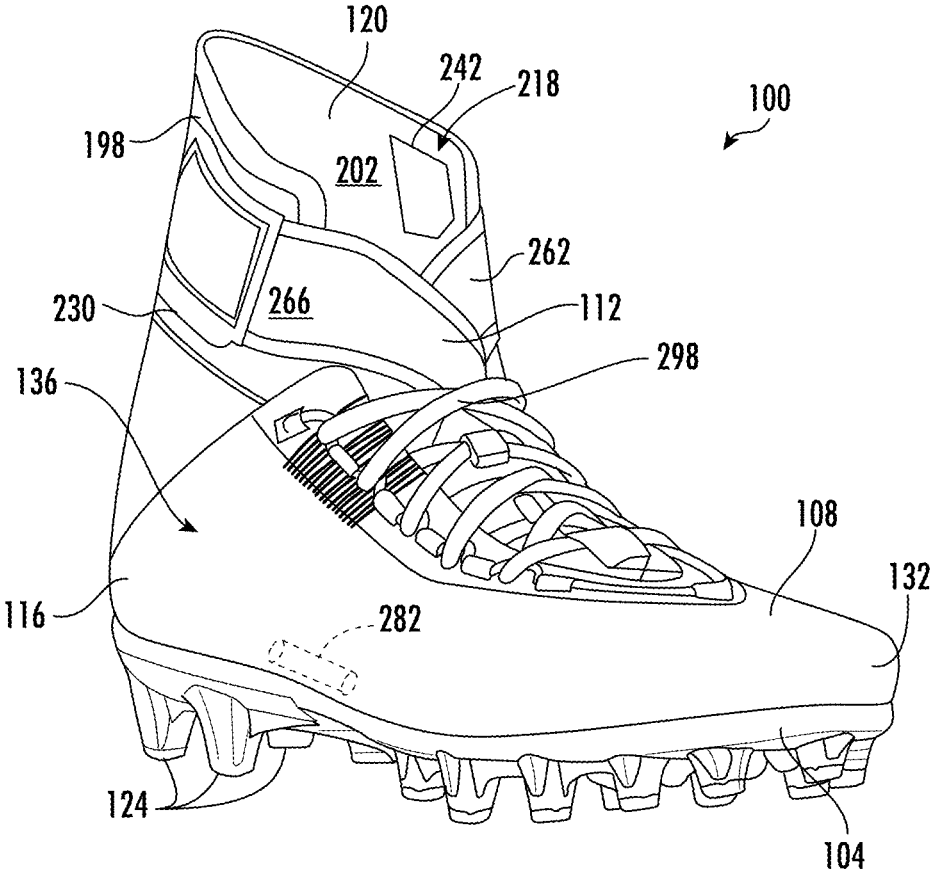
FIG. 1 is a perspective view of an article of footwear, as disclosed herein, in a first configuration in which a collar of the article of footwear is in an upright position.

For the purpose of promoting an understanding of the principles of the disclosure, reference will now be made to the embodiments illustrated in the drawings and described in the following written specification. It is understood that no limitation to the scope of the disclosure is thereby intended. It is further understood that this disclosure includes any alterations and modifications to the illustrated embodiments and includes further applications of the principles of the disclosure as would normally occur to one skilled in the art to which this disclosure pertains.

Aspects of the disclosure are disclosed in the accompanying description. Alternate embodiments of the disclosure and their equivalents may be devised without parting from the spirit or scope of the disclosure. It should be noted that any discussion herein regarding "one embodiment," "an embodiment," "an exemplary embodiment," and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

For the purposes of the disclosure, the phrase "A and/or B" means (A), (B), or (A and B). For the purposes of the disclosure, the phrase "A, B, and/or C" means (A), (B), (C), (A and B), (A and C), (B and C), or (A, B and C).

The terms "comprising," "including," "having," and the like, as used with respect to embodiments of the disclosure, are synonymous.

As used herein, an "article of footwear" refers to an article of apparel designed and configured to be worn on a wearer's foot. Exemplary articles of footwear include, but are not limited to: athletic shoes such as basketball shoes, running shoes, walking shoes, and tennis shoes; athletic cleated or spiked shoes such as golf shoes, football cleats, soccer cleats, baseball cleats, lacrosse cleats, and track spikes; boots such as hiking boots or skiing boots; ice skates; and roller skates or inline skates. The illustrated embodiments depict football cleats, although the reader should appreciate that the features described herein may be used with any desired article of footwear.

Figure 2:
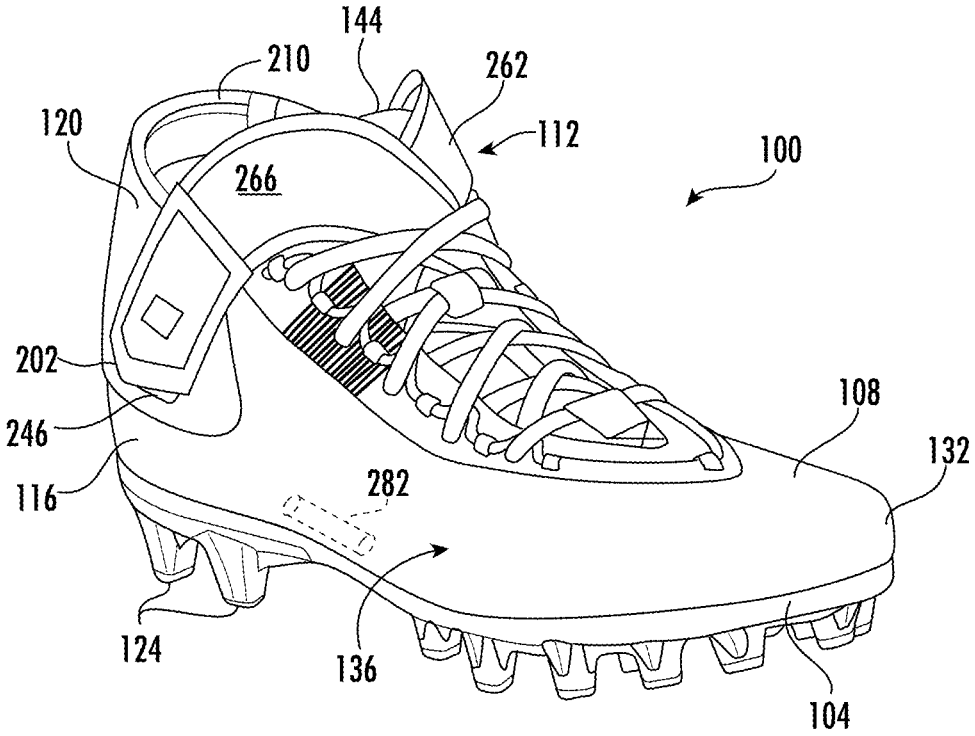
FIG. 2 is a perspective view of the article of footwear of FIG. 1 showing the article of footwear in a second configuration in which the collar is in a lowered position.

As shown in FIG. 1, an article of footwear, referred to herein as a shoe 100, includes a sole 104, an upper 108 connected to the sole 104, and a strap 112 extending from the upper 108. The upper 108 includes a hindfoot portion 116 and a collar 120 extending from the hindfoot portion 116. The strap 112 is configured for connection to the collar 120. The collar 120 is movable to an upright position (FIG. 1) and a lowered position (FIG. 2). In the upright position, the collar 120 configures the shoe 100 in a high-top style, and the strap 112 is connected to the collar 120 to securely mount the shoe 100 to the wearer's foot. In the lowered position of FIG. 2, the collar 120 is folded down and overlaps with the hindfoot portion 116 to convert the shoe 100 to a mid-top or a low-top style. In the lowered position, the strap 112 is connected to an opposite side of the collar 120 to securely mount the shoe 100 to the wearer's foot. Each component of the shoe 100 is described in greater detail herein.

With reference again to FIG. 1, the sole 104 is a ground-engaging portion of the shoe 100 and is also referred to as an outsole. In the exemplary embodiment, the sole 104 includes a plurality cleats 124 or studs (also called lugs) to provide traction on grassy, soft, and slippery surfaces. The sole 104, in one embodiment, is formed from injection molded thermoplastic. In other embodiments, the sole 104 is formed without cleats and the shoe 100 is alternatively provided as a running shoe or a hiking shoe, for example. In such an embodiment, the sole 104 is formed from rubber and/or ethylene-vinyl acetate (EVA).

The upper 108 is connected to the sole 104 and includes a plurality of components that cover the foot of the wearer. In particular, the upper 108 includes the hindfoot portion 116, the collar 120, and a forefoot portion 132. The forefoot portion 132 is configured to receive the forefoot of the wearer including the wearer's toes. The hindfoot portion 116 is configured to receive the hindfoot of the wearer including at least a portion of the wearer's heel. The upper 108, in some embodiments, is also described as including a toe cap, a vamp, and a heel counter, as is known in the art. In such an embodiment, the collar 120 extends from the heel counter of the upper 108.

The upper 108 is formed from any of various materials. For example, the upper 108 may include polyester, elastane, mesh, synthetic leather or natural leather, or any of various other materials or combinations thereof. The materials used to form the upper 108 depend, in part, on the particular type of the shoe. For example, heavier and more rugged materials, such as leather, are more prevalent on the upper 108 when the shoe 100 is a cleat or boot. Whereas, light-weight mesh or elastane fabric are more prevalent on the upper 108 when the shoe 100 is a running shoe, a basketball shoe, or a tennis shoe. Various methods are used to attach the upper 108 and the sole 104, including the use of adhesives, welting, or any of various other methods, as will be recognized by those of ordinary skill in the art.

The upper 108 in combination with a portion of the sole 104 defines a foot cavity 136 (FIG. 1) configured to receive the wearer's foot and ankle. As used herein, an exterior side of the upper 108 faces away from the foot cavity 136, and an interior side of the upper 108 faces toward the foot cavity 136 and/or defines the foot cavity 136. Moreover, the upper 108 defines a medial side that is on the same side of the shoe 100 as the medial side of the wearer's foot, and a lateral side that is on the same side of the shoe 100 as the lateral side of the wearer's foot.

Figure 3:
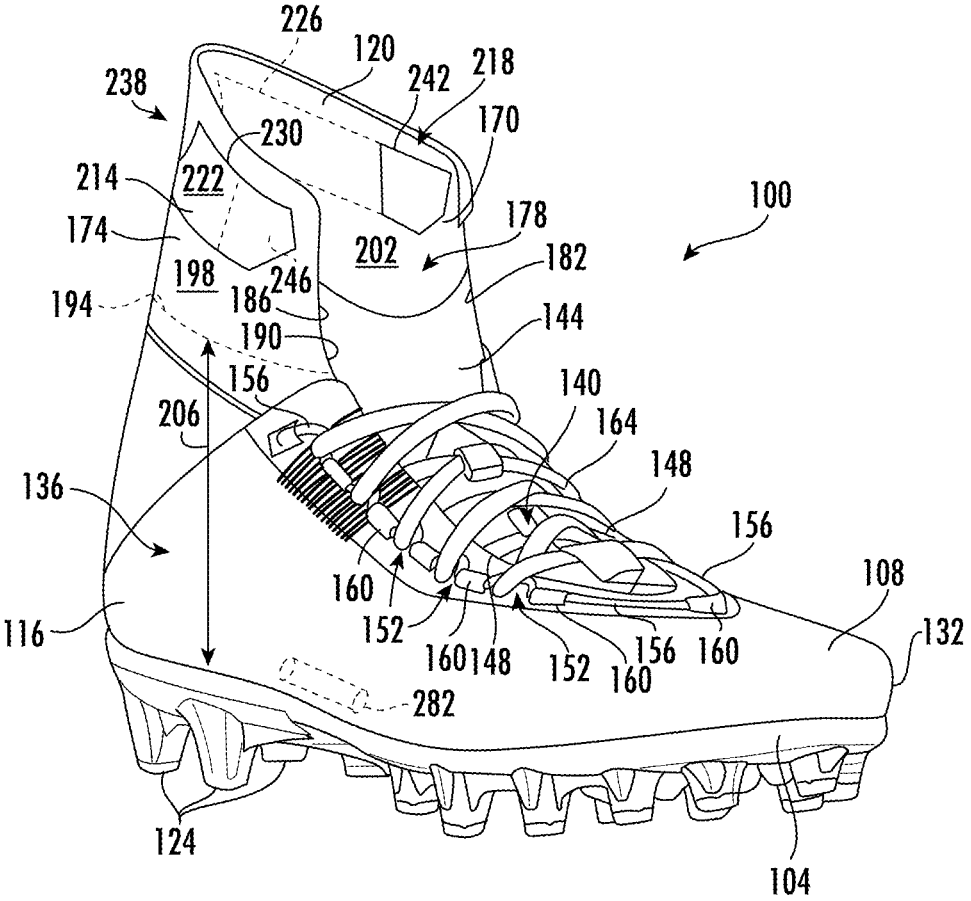
FIG. 3 is another perspective view of the article of footwear of FIG. 1 shown without a strap of the article of footwear.

As shown in FIG. 3, the upper 108 further defines a throat opening 140 and includes a tongue 144. Specifically, in one embodiment, the upper 108 includes a U-shaped or V-shaped throat edge 148 that at least partially defines the throat opening 140. The throat opening 140 enables separation of the lateral and the medial sides of the upper 108 so that the wearer can comfortably insert her foot into the foot cavity 136.

The tongue 144 extends from the forefoot portion 132 of the upper 108 towards the hindfoot portion 116 of the upper 108. The tongue 144 at least partially covers the throat opening 140 when the shoe 100 is worn.

The upper 108 also includes a plurality of eyelets 152 defined in part by at least one eyelet line 156. In the example of FIG. 1, the shoe 100 includes one eyelet line 156 that is connected at both ends to the upper 108 and that extends through a plurality of loops 160 positioned on the throat 148 adjacent to the throat opening 140. The eyelets 152 are located between the loops 160 and are formed by the eyelet line 156. The eyelets 152 are configured to receive a lace 164 for securing the shoe 100 to the wearer. Additionally or alternatively, the eyelets 152 are formed as openings in the upper 108 through which the laces 164 extend and/or the eyelets 152 are defined by grommets attached to the upper 108.

With continued reference to FIG. 3, the collar 120, which extends from the hindfoot portion 116 of the upper 108, is formed from the same material(s) as the hindfoot portion 116 and is an integral extension of the hindfoot portion 116. In another embodiment, the collar 120 is formed from any suitable material and is a separate element that is attached to the hindfoot portion 116, such as by sewing or gluing to the hindfoot portion 116.

The collar 120, in the exemplary embodiment of FIG. 3, is an open collar that includes a medial collar side 170 spaced apart from a lateral collar side 174 by a collar opening 178. In particular, a medial collar edge 182 of the medial collar side 170 and a lateral collar edge 186 of the lateral collar side 174 are spaced apart from each other and at least partially define the collar opening 178. The collar 120 extends from the medial collar edge 182, to the rear of the hindfoot portion 116, and around to the lateral collar edge 186. The collar opening 178 is aligned with and connected to the throat opening 140. The collar 120 is not configured to extend completely around the wearer's leg and/or ankle as is a conventional cuff, sock, or gaiter.

As shown in FIG. 3, the lateral collar edge 186 and a portion of the throat edge 148 extending from the lateral collar edge 186 define an obtuse angle 190. A corresponding obtuse angle 190 is defined on the medial side of the shoe 100 but is not visible in FIG. 3 due to the angle of the perspective view. The obtuse angles 190 between the collar edges 182, 186 and the throat edge 148 portions position the collar 120 comfortably in the upright position.

The collar 120 is movable from the upright position (i.e. a first configuration and/or a first position as shown in FIGS. 1 and 3) to the lowered position (i.e. a second configuration and/or a second position as shown in FIG. 2) by folding the collar 120 about a fold line 194 (FIG. 3) so that the collar 120 is positioned against and/or overlaps with the hindfoot portion 116. In the upright position, a first shown side 198 of the collar 120 is the exterior side of the collar 120, and an opposite second shown side 202 of the collar 120 is an interior side of the collar 120. In the upright position, the second shown side 202 is positioned against the wearer's leg or sock. In the lowered position the second shown side 202 of the collar 120 is the exterior side of the collar 120. When the collar 120 is in the lowered position, the first shown side 198 is positioned against the exterior side of the hindfoot portion 116 and faces toward the foot cavity 136. In the lowered position, the first shown side 198 is the interior side of the collar 120.

As shown in FIG. 3, the fold line 194 is a fold distance 206 from the sole 104. A length of the fold distance 206 determines, at least in part, the style or configuration of the shoe 100 when the collar 120 is in the lowered position, with a shorter fold distance 206 corresponding to a lower topline 210 (FIG. 2) of the shoe 100. Accordingly, in an embodiment, by selecting a suitable fold distance 206, the shoe 100 is convertible from (i) a high-top to a mid-top, (ii) a high-top to a low-top, and (iii) a mid-top to a low-top. In another embodiment, the collar 120 includes two configurations: a first, upward or high-top configuration and a second, lowered or low-top configuration, in which the collar 120 is folded downward along the fold line 194.

The collar 120 includes one or more collar fasteners 214, 218 adapted to mate with an associated fastener on the strap 112. In an embodiment, a first collar fastener 214 is mounted to the exterior surface 198 of the collar 120, and a second collar fastener 218 is mounted to the interior surface 202 of the collar 120. The fasteners 214, 218 are shown partially in phantom in FIG. 3. The first collar fastener 214 is mounted to the first shown side 198 of the collar 120, as shown in FIG. 3. In one embodiment, the first collar fastener 214 includes a fastener pad 222 that extends continuously from the medial collar side 170 to the lateral collar side 174. The fastener pad 222 may be any operable fastener configured to secure the strap 112 to the collar 120. In the embodiment illustrated, the collar fastener pad 222 is a component of a hook and loop fastener system (e.g., a VELCRO system).

Figure 4:
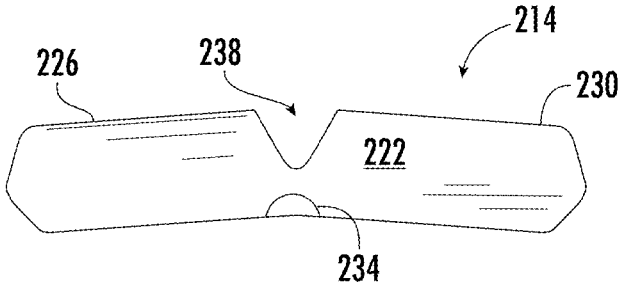
FIG. 4 illustrates a first collar fastener of the article of footwear of FIG. 1.

With reference to FIG. 4, the fastener pad 222 of the first collar fastener 214 includes a medial fastener side 226 and a lateral fastener side 230 (with reference to the right shoe 100 of FIG. 3), which are at a fastener angle 234 with respect to each other. In one embodiment, the fastener angle 234 is approximately 190° and ranges from 160° to 220°. As used herein, approximately 190° is plus or minus 5° from 190°. A v-shaped notch 238 is defined in the fastener pad 222 near the vertex of the fastener angle 234. The notch 238 is centered about the rear of the collar 120. The fastener angle 234 and the notch 238 make the fastener pad 222 lay flat against the first shown side 198 of the collar 120. The medial fastener side 226 is also referred herein to as a medial portion of the first collar fastener 214, and the lateral fastener side 230 is also referred herein as a lateral portion of the first collar fastener 214.

Figure 5:
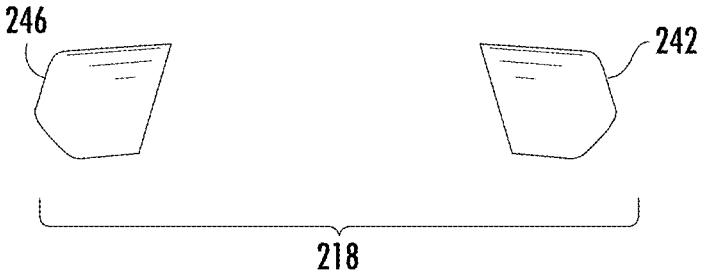
FIG. 5 illustrates a second collar fastener of the article of footwear of FIG. 1.

As shown in FIG. 5, the second collar fastener 218 includes a medial fastener pad 242 and a lateral fastener pad 246 (with reference to the right shoe 100 of FIG. 3). In one embodiment, the fastener pads 242, 246 have the same shape as corresponding end portions of the first collar fastener 214. The fastener pads 242, 246 of the second collar fastener 218 are mounted to the second shown side 202 of the collar 120. In particular, the medial fastener pad 242 (i.e. a second fastener pad) is connected to the second shown side 202 of the collar 120 on the medial collar side 170, and the lateral fastener pad 246 (i.e. a third fastener pad) is connected to second shown side 202 of the collar 120 on the lateral collar side 174. In one embodiment, the fastener pads 242, 246 are provided as another instance of the plurality of loops of the hook and loop fastener system. In FIG. 5, and when attached to the shoe 100, the medial fastener pad 242 and the lateral fastener pad 246 are spaced apart from each other, such that no portion of the lateral fastener pad 246 is in contact with the medial fastener pad 242.

FIG. 3 illustrates that a footprint of the second collar fastener 218 is aligned with a footprint of the first collar fastener 214. Specifically, the footprint of the medial fastener pad 242 is aligned with the footprint of the medial fastener side 226 of the first fastener pad 222, and the footprint of the lateral fastener pad 246 is aligned with the footprint of the lateral fastener side 230 of the first fastener pad 222. In embodiments, the aligned portions of the fastener pads 222, 242, 246 may have substantially the same dimensions (size and shape) or may possess dimensions (size/shape) that differ from each other. In one embodiment, the aligned fastener pads 222, 242, 246 are positioned over the wearer's ankle when the collar 120 is the lowered position. Accordingly, the fastener pads 222, 242, 246 and the collar 120 are padding for the wearer's ankle when the collar 120 is in the lowered position.

Figure 6:
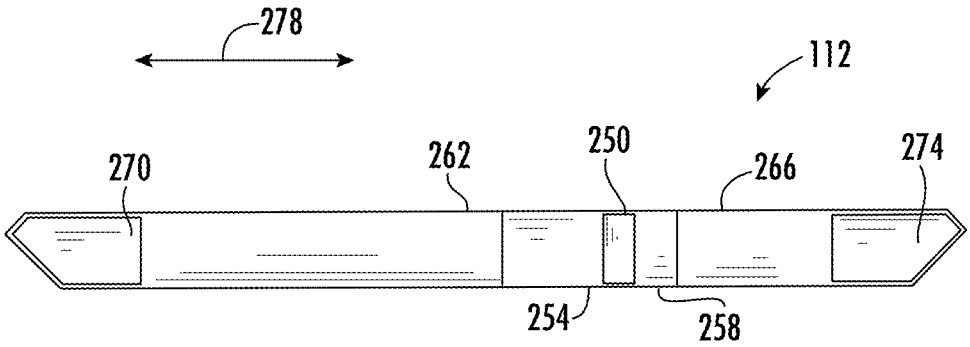
FIG. 6 illustrates the strap of the article of footwear of FIG. 1 in an elongated configuration.

With reference to FIG. 6, the strap 112 includes a connection portion 250, elastic portions 254, 258, substantially inextensible portions 262, 266, a medial fastener 270, and a lateral fastener 274. The connection portion 250 is connected to the interior side of the upper 108 and is located in the foot cavity 136. In an example, the connection portion 250 is permanently connected to the medial side of the upper 108 at a position near an arch of the wearer's foot. As used herein, "permanently connected" elements cannot be separated without destroying at least one of the elements. In another embodiment, the connection portion 250 is removably connected to the upper 108, to permit user replacement of the strap 112, for example.

The elastic portions 254, 258 extend from opposing sides of the connection portion 250. The elastic portion 254 is longer than the elastic portion 258. The long elastic portion 254 extends under the wearer's foot between the foot and the sole 104 or sock liner (not shown). In one embodiment, the elastic portions 254, 258 are stretchable to double their relaxed or un-stretched lengths in the directions of an axis 278.

The substantially inextensible portion 262 extends from the elastic portion 254, and the substantially inextensible portion 266 extends from the elastic portion 258. The substantially inextensible portion 262 is longer than the substantially inextensible portion 266. The substantially inextensible portions 262, 266 do not stretch when pulled against the connection portion 250 along the axis 278. As used herein, an element is "substantially inextensible" when it stretches less than 5% of its length in response to a corresponding force along the length. For example, a pulling force exerted upon the long inextensible portion 262 is transferred to the elastic portion 254 and results in stretching of the elastic portion 254 and no observable stretching of the long inextensible portion 262.

The medial fastener 270 (i.e., a first strap fastener) is mounted on the long inextensible portion 262 at a first end of the strap 112, and the lateral fastener 274 (i.e., a second strap fastener) is mounted on the short inextensible portion 266 at a second end of the strap 112. In one embodiment, the medial and lateral fasteners 270, 274 each include a plurality of hooks of the hook and loop fastener system. Accordingly, the medial and lateral fasteners 270, 274 are configured for connection to the first and second collar fasteners 214, 218 that each include the plurality of loops of the hook and loop fastener system. Specifically, in the upright position of the collar 120 in FIG. 1, the medial fastener side 226 of the first fastener pad 222 connects to the medial fastener 270 of the strap 112, and the lateral fastener side 230 of the first fastener pad 222 connects to the lateral fastener 274 of the strap 112. In the lowered position of the collar 120 in FIG. 2, the medial fastener pad 242 connects to the medial fastener 270 of the strap 112, and the lateral fastener pad 246 connects to the lateral fastener 274 of the strap 112. Other suitable fastening systems may be used in addition or alternative to the hook and loop fastener system to connect the strap 112 to the collar 120. For example, other suitable fastening systems to connect the strap 112 to the collar 120 include hook and eye closures, ratchet systems, buckles, notched cam strips, and any other suitable connection mechanism. Moreover, as used herein, the hook and loop fastener system includes all types of such systems including those with mushroom-stems on each face of the fastener, and those with hooks and loops on each face of the fastener.

As shown in FIGS. 1 and 2, when the strap 112 is connected to the collar 120, the strap 112 is configured in a crossed or overlapped position. In particular, the long inextensible portion 262 extends from the lateral side of the upper 108 and connects to the medial collar side 170 of the collar 120, and the short inextensible portion 266 extends from the medial side of the upper 108 and connects to the lateral collar side 174 of the collar 120. The crossed portion of the strap 112 is located between the tongue 144 and the laces 164. Accordingly, the strap 112 holds the tongue 144 against the wearer's foot and enables the laces 164 to be freely adjusted, positioned, and/or tied.

Figure 7:
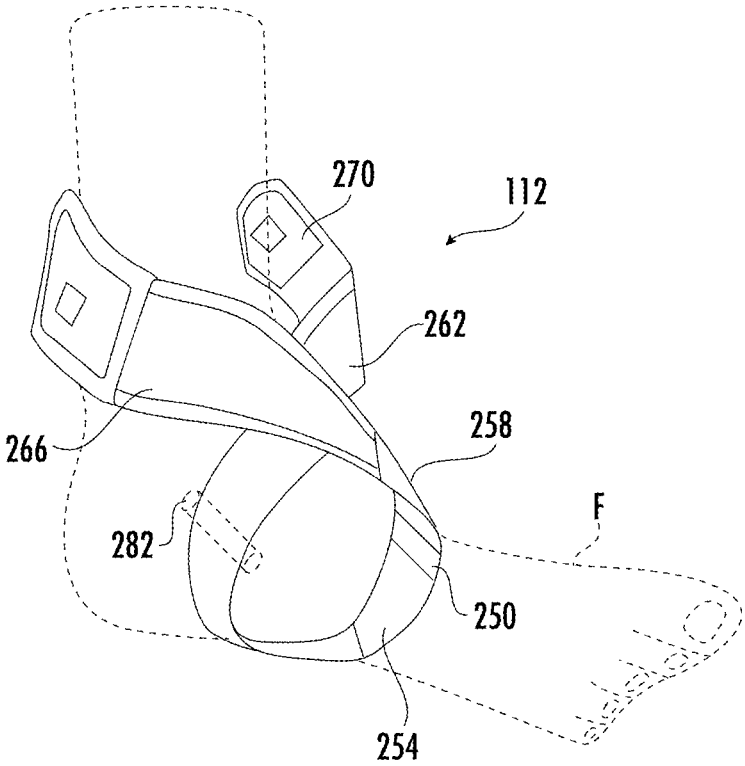
FIG. 7 is a perspective view showing the strap of the article of footwear of FIG. 1 in a supportive position around a wearer's foot.
Figure 8A:
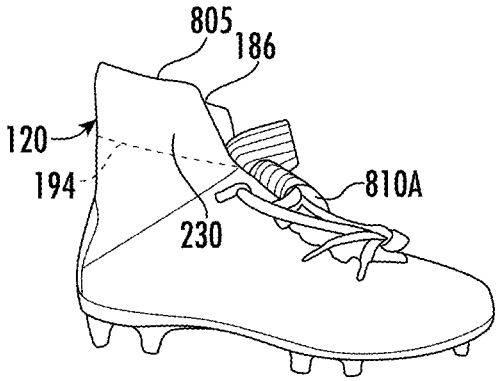
FIGS. 8A, 8B, 8C, 8D and 8E illustrate the article of footwear in the raised collar lockdown configuration.
Figure 8B:
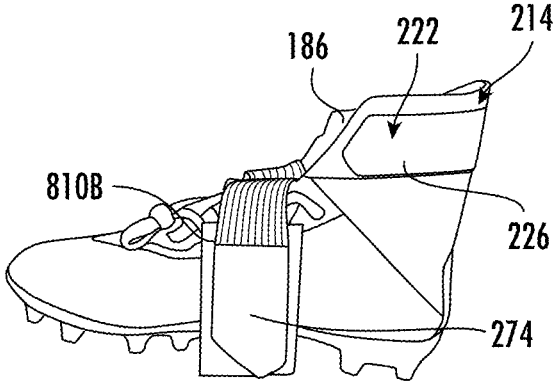
Figure 8C:
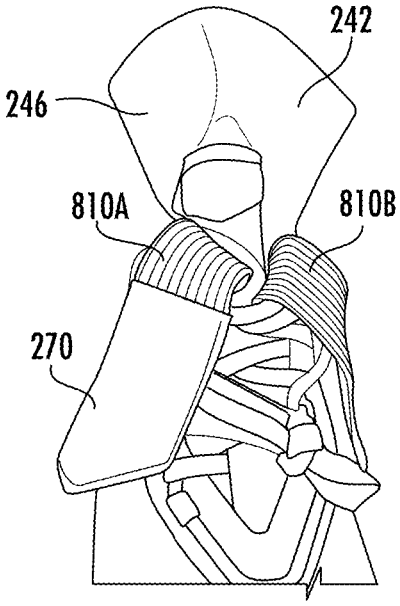
Figure 8D:
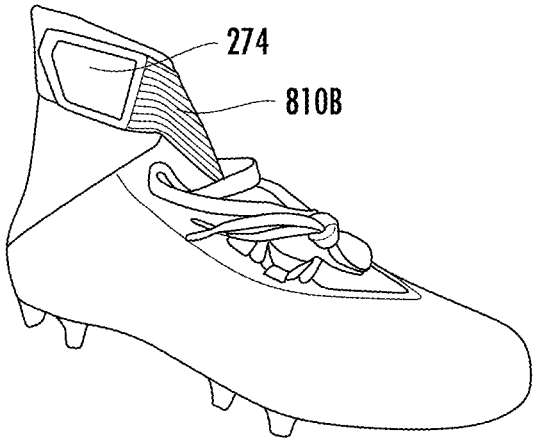
Figure 8E:
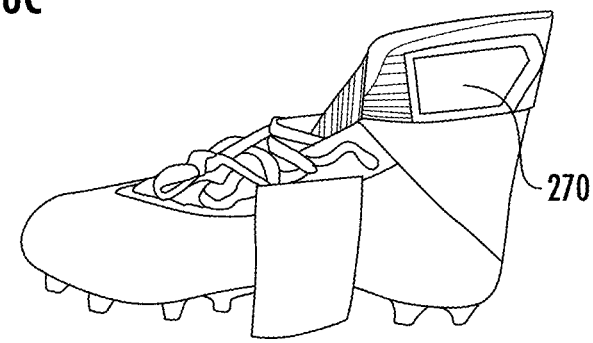
Figure 9A:
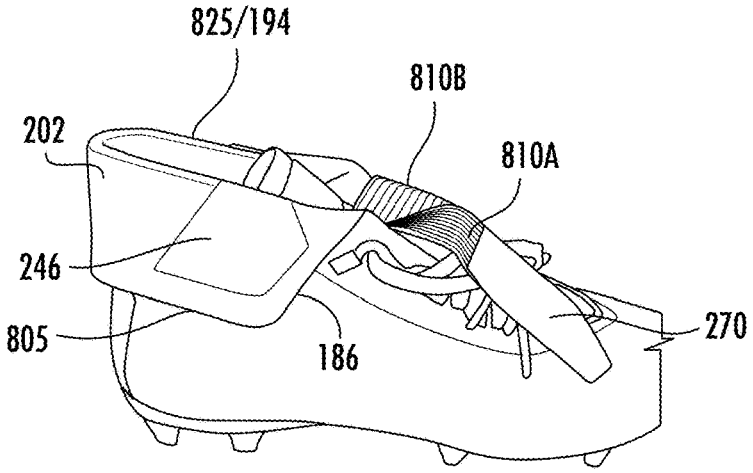
FIGS. 9A, 9B, 9C, and 9D illustrate the article of footwear in the lowered collar lockdown configuration.
Figure 9B:
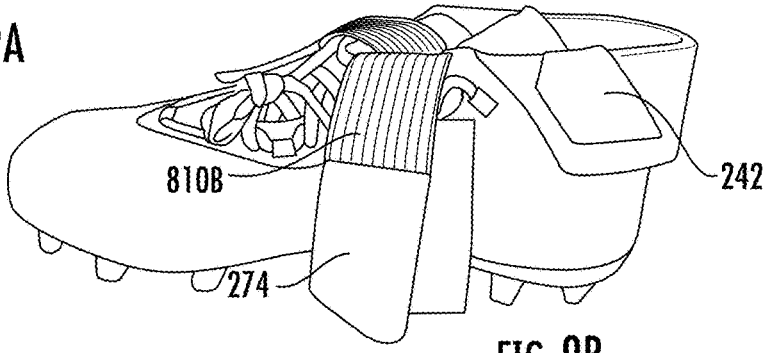
Figure 9C:
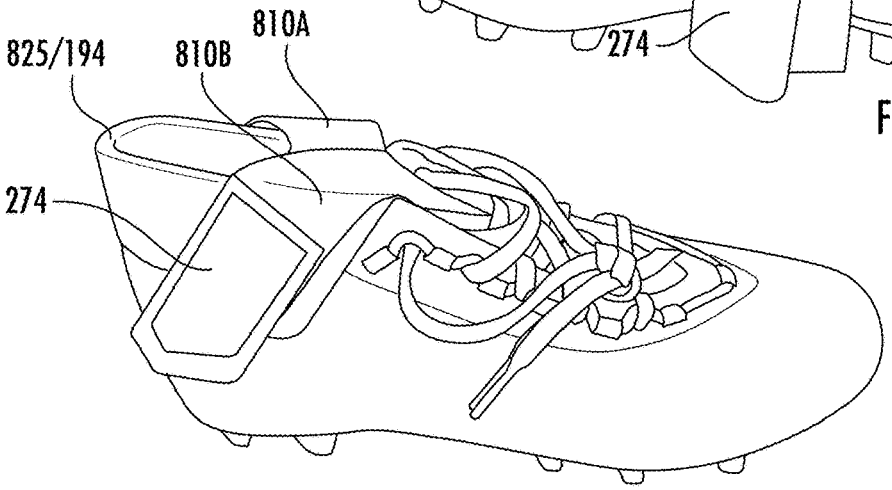
Figure 9D:
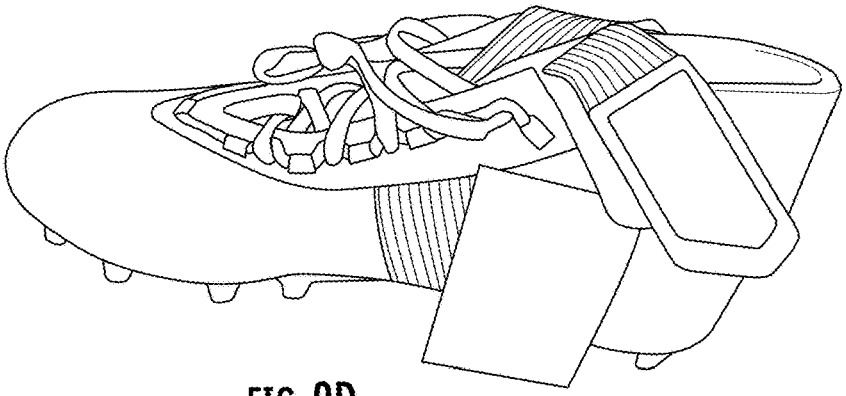

As shown in FIG. 7, the strap 112 is illustrated as positioned when the strap 112 is connected to the upright collar 120, but the sole 104, the upper 108, the tongue 144, and the laces 164 are not shown. The wearer's foot F is shown in phantom. The strap 112 securely connects the shoe 110 to the foot F, as assisted by the laces 164.

FIG. 7 also illustrates that the shoe 100 includes a strap loop 282 positioned in the foot cavity 136 and permanently connected to the interior side of the upper 108 on the lateral side of the upper 108. The strap 112 passes between the strap loop 282 and the upper 108, and the strap 112 is movable relative to the strap loop 282. The strap loop 282 prevents movement of a portion of the strap 112 toward the heel and the toes of the wearer, but allows the strap 112 to slide relative to the upper 108 when a tightening force is applied to the strap 112.

In an exemplary method of operation, the wearer inserts their foot into the foot cavity 136. Next, the wearer raises the collar 120 for the upright position or folds down the collar 120 about the fold line 194 for the lowered position. The wearer selects the position of the collar 120 based on the situation and/or activity to be performed. Accordingly, in a first situation, the wearer utilizes the shoe 100 with the collar 120 in the upright position, and then in a second situation different from the first situation, the wearer converts the shoe 100 to the lowered position of the collar 120. In this way, the wearer has an optimal shoe style and/or configuration from one pair of shoes.

After the collar 120 is positioned, the wearer connects the medial fastener 270 of the strap 112 to the medial fastener pad 242 or the medial fastener side 226 of the fastener pad 222 (depending on the selected position). The wearer typically applies a tension force to the strap 112 during the attachment that stretches slightly the long elastic portion 254. Next, the wearer connects the lateral fastener 274 to the lateral fastener pad 246 or the lateral fastener side 230 of the fastener pad 222 (depending on the selected position). The wearer typically applies a tension force to the strap 112 during the attachment that stretches slightly the short elastic portion 258.

After both fasteners 270, 274 are connected to the collar 120, the wearer adjusts and ties the laces 164. As shown in FIG. 1, the inextensible portions 262, 266 extend from the foot cavity 136 behind the final lace crossing 298 so that the laces 164 are freely and easily adjustable and are prevented from binding against the strap 112. The knot of the tied laces 164, in one embodiment, is positioned against the crossing of the strap 112.

With the above configuration, an article of footwear including multiple locking positions/configurations is provided. Referring to FIGS. 8A-8E, in the first lockdown position, the collar or cuff 120 is oriented in its unfolded or high-top configuration. In this configuration, the collar top edge 805 is distanced from (e.g., positioned above) the malleolus (ankle bone) of the wearer. Additionally, the exterior surface 198 of the cuff 120 is exposed to reveal the first mating collar fastener 214 (with fastener pad 222 disposed along the lateral and medial sides of the upper), which is positioned above the fold line 194 and, as such, above the malleolus of the wearer. This permits a first distal strap portion 810A and its associated strap fastener 274 to connect to the lateral portion 230 of the fastener pad 222 at a position above the malleolus. Specifically, the first distal strap portion 810A of the strap 112 (including the first strap fastener 274) extends from foot cavity, out through the tongue opening and across the forward collar edge 186 (but below the top collar edge 805), where it couples (connects) to the outer or lateral fastener pad 222. In other words, the distal strap portion 810A and its associated strap fastener 274 is positioned above the fold line 194.

The collar 120 is further convertible from the upright configuration (i.e., the first configuration and/or a first position as shown in FIGS. 8A-8E) to a lowered or folded configuration as shown in FIGS. 9A-9D. Specifically, the collar 120 is folded downward, about the fold line 194 (FIG. 3) such that the portion of the collar 120 above the fold line is positioned against and/or overlaps with the hindfoot portion 116, exposing the inner collar surface 202. In this second or folded configuration (also called a low-top configuration), the fold line 194 now defines the top edge 825 of the collar 120. The collar top edge 825, moreover, is now oriented closer to (e.g., proximate to or slightly above) the malleolus of the wearer.

As explained above, in the upright position, the first or outer side 198 of the collar 120 forms the exterior of the upper, and the second or inner side 202 of the collar 120 defines the interior side of the upper, with the second shown side 202 facing the wearer's leg or sock. The collar fasteners 214, 218, moreover, are positioned above the fold line 194.

In the lowered configuration, however, the interior side 202 of the collar 120 is exposed, effectively defining the exterior of the upper. That is, when the collar 120 is in the lowered position, the first shown side 198 is positioned against the exterior side of the hindfoot portion 116 and faces toward the foot cavity 136. In addition, the second mating collar fastener 218 and, in particular, the lateral fastener 242 and medial fastener 246 (which were inside the foot cavity when the collar is in its upward, high top configuration) are now exposed, being positioned proximate the top collar edge 825 (but below the original fold line 194).

The operation of the strap lockdown system also differs. Specifically, each distal portion 810A, 810B of the strap exits from the foot cavity (via tongue opening), crossing from the lateral side to the medial side (or vice versa), overlapping. The strap fasteners 270, 274 approach the now exposed second collar fasteners 218 by extending over the fold line 194 (the top collar edge 825 of the second configuration) and down the exterior of the collar 120 to connect with a respective fastener 242, 246.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. An article of footwear, comprising:

a sole;

an upper connected to the sole and including a hindfoot portion and an open collar extending from the hindfoot portion, the collar defining a collar opening, and the upper defining a throat opening aligned with the collar opening;

at least one first collar fastener including a first fastener pad mounted to a first side of the collar;

at least one second collar fastener including a second fastener pad mounted to an opposite second side of the collar, the collar configured for movement between (i) a first position in which the first side of the collar is an exterior side of the collar and the second side of the collar is an interior side of the collar, and (ii) a second position in which the second side of the collar is the exterior side of the collar and the first side of the collar is the interior side of the collar; and a strap extending from a foot cavity at least partially defined by the upper, the strap including at least one strap fastener configured for selective connection to one of the at least one first collar fastener and the at least one second collar fastener.

2. The article of footwear of claim 1, the strap further comprising:

a first substantially inextensible portion extending from a first elastic portion and a second substantially inextensible portion extending from a second elastic portion.

3. The article of footwear as claimed in claim 2, wherein the at least one strap fastener includes:

a first strap fastener is mounted on the first substantially inextensible portion and is configured to connect to the collar, and a second strap fastener is mounted on the second substantially inextensible portion and is configured to connect to the collar.

4. The article of footwear as claimed in claim 1, wherein:

the first position of the collar is an upright position of the collar, and the second position of the collar is a lowered position of the collar.

5. The article of footwear of claim 1, the strap including (i) a connection portion permanently connected to an interior side of the upper, (ii) a first elastic portion extending from the connection portion, and (iii) a first substantially inextensible portion extending from the first elastic portion.

6. The article of footwear of claim 5, the strap further including (iv) a first strap fastener mounted on the first substantially inextensible portion, (v) a second elastic portion extending from the connection portion, (vi) a second substantially inextensible portion extending from the second elastic portion, and (vii) a second strap fastener mounted on the second substantially inextensible portion.

* * * * *